United States Patent [19]

Isozumi

[11] Patent Number: 4,918,324

[45] Date of Patent: Apr. 17, 1990

[54] COAXIAL ENGINE STARTER

[75] Inventor: Shuzoo Isozumi, Himeji, Japan

[73] Assignee: Mitsubishi Denki Kabushiki Kaisha, Tokyo, Japan

[21] Appl. No.: 296,104

[22] Filed: Jan. 12, 1989

[30] Foreign Application Priority Data

Jan. 13, 1988 [JP] Japan ..... 63-6112

[51] Int. Cl.[4] ..... F02N 15/06

[52] U.S. Cl. ..... 290/48; 74/7 A; 310/43

[58] Field of Search ..... 290/38 R, 48; 74/7 R, 74/7 H, 7 C, 7 E; 310/43

[56] References Cited

U.S. PATENT DOCUMENTS

| | | | |
|---|---|---|---|
| 4,347,442 | 8/1982 | White et al. | 290/48 |
| 4,553,442 | 11/1985 | Mazzorana | 74/7 A |
| 4,649,285 | 3/1987 | Mazzorana et al. | 290/48 |
| 4,760,274 | 7/1988 | Isozumi | 290/48 |

FOREIGN PATENT DOCUMENTS 1311876 11/1962 France .

*Primary Examiner*—A. D. Pellinen
*Assistant Examiner*—W. E. Duncanson, Jr.
*Attorney, Agent, or Firm*—Sughrue, Mion, Zinn, Macpeak and Seas

[57] ABSTRACT

A coaxial engine starter in which a solenoid switch is disposed behind an electric motor, a planetary speed reduction gear is disposed in front of the electric motor, and an ouptut rotary shaft is driven by the electric motor through the planetary speed reduction gear, a housing to which a bearing for receiving radial loads from the output rotary shaft is secured is integrally formed by a synthetic resin with an inner gear of the planetary speed reduction gear. A metallic flange for attaching the starter to an engine may be mounted to the housing by an electrically conductive securing member, and an electrical conductor for electrically connecting the flange to a motor yoke through the securing member may also be provided.

2 Claims, 3 Drawing Sheets

COAXIAL ENGINE STARTER

BACKGROUND OF THE INVENTION

This invention relates to a coaxial engine starter in which an operating rod of a solenoid switch and a motor rotor shaft are coaxially arranged.

FIG. 1 is a sectional view of a conventional engine starter, in which the engine starter comprises a front bracket 1 which serves as an outer housing of the starter with which the starter is mounted to an unillustrated engine. An output rotary shaft 2 is rotatably supported at its front end by a bearing 3 fitted in the front bracket 1. An over-running clutch 4 is axially slidably placed over the output rotary shaft 2. The over-running clutch 4 includes a clutch outer member 4*a* having splines 5 formed at its rear (left in FIG. 1) portion, a clutch inner member 4*b* having pinion 6 formed at its front (right in FIG. 1) and rollers disposed between the clutch outer 4*a* and the clutch inner 4*b*. A rotary shaft 7 of an electric motor has formed thereon a sun gear 7*a* of a planetary speed reduction gear which comprises an inner gear 8 and planetary gears 9.

The engine starter also comprises a solenoid switch 10 for controlling the electric current flowing into the starter and for moving forward the over-running clutch 4 through a pivotable lever 11. One end of the lever 11 is connected to a plunger 10*a* of the solenoid switch 10 and the other end is connected to the rear portion of the over-running clutch 4. A motor yoke 12 and a rear bracket 13 are securely connected to the front bracket 1 by bolts 14.

When an unillustrated ignition switch is turned on to start an engine, the solenoid switch 10 is closed and the motor rotor shaft 7 is rotated. The rotation of the shaft 7 is transmitted through the planetary speed reduction gear to the output rotary shaft 2 to drive the over-running clutch 4 which is connected to the output rotary shaft 2 through splines. Also, the lever 11 is pivotted by the forward movement of the plunger 10*a* of the solenoid switch 10 to move forward the over-running clutch 4. This causes the pinion 6 to engage the ring gear (not shown) of the engine so that the rotation of the shaft 7 is transmitted to the engine to start the engine. After the engine has been started, the rotation of the engine at a higher speed is transmitted to the pinion 6 through the ring gear. This rotational force of the pinion 6 is not transmitted to the motor shaft 7 due to the function of the over-running clutch 4 in which the backward transmission of the rotational force is prevented by the rollers 4*c* idling between the clutch outer member 4*a* and the clutch inner member 4*b*.

With the conventional engine starter as above described, the starter motor and the solenoid switch are arranged with their shafts in parallel to each other, so that a limitation is often imposed upon the engine layout. Further, several types of the front bracket must be designed separately for each model of the engine with the positions of the solenoid switch and the engine mounting opening of the front bracket taken into consideration. Therefore, the manufacturing cost is relatively high. Also, while the inner gear 8 is made by molding, the front bracket 1 is machined after die-casting, whereby the number of the manufacturing steps is large and the weight of the front bracket is heavy.

SUMMARY OF THE INVENTION

Accordingly, one of the objects of the present invention is to provide a coaxial engine starter which is less expensive.

Another object of the present invention is to provide a coaxial engine starter which is lighter than the starter of the conventional design.

Still another object of the present invention is to provide a coaxial engine starter utilizing a mounting flange adapted to the engine to which the starter is mounted.

A further object of the present invention is to provide a coaxial engine starter utilizing an inner gear integrally formed on the front bracket.

With the above objects in view, the coaxial engine starter of the present invention comprises an electric motor, a solenoid switch coaxially disposed behind the motor, a planetary gear speed reduction mechanism disposed in front of the electric motor, and an output rotary shaft driven by the electric motor through the planetary speed reduction gear. A housing to which a bearing for receiving radial loads from the output rotary shaft is secured and an inner gear of said planetary speed reduction gear are integrally formed by a resin material. A mounting flange for attaching the starter to an engine is mounted to the housing.

The mounting flange may be electrically conductive and may be mounted to the housing by an electrically conductive securing member, and electrically conducting means for electrically connecting the flange and a yoke of the electric motor through the securing member may be provided.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

Figure 1:
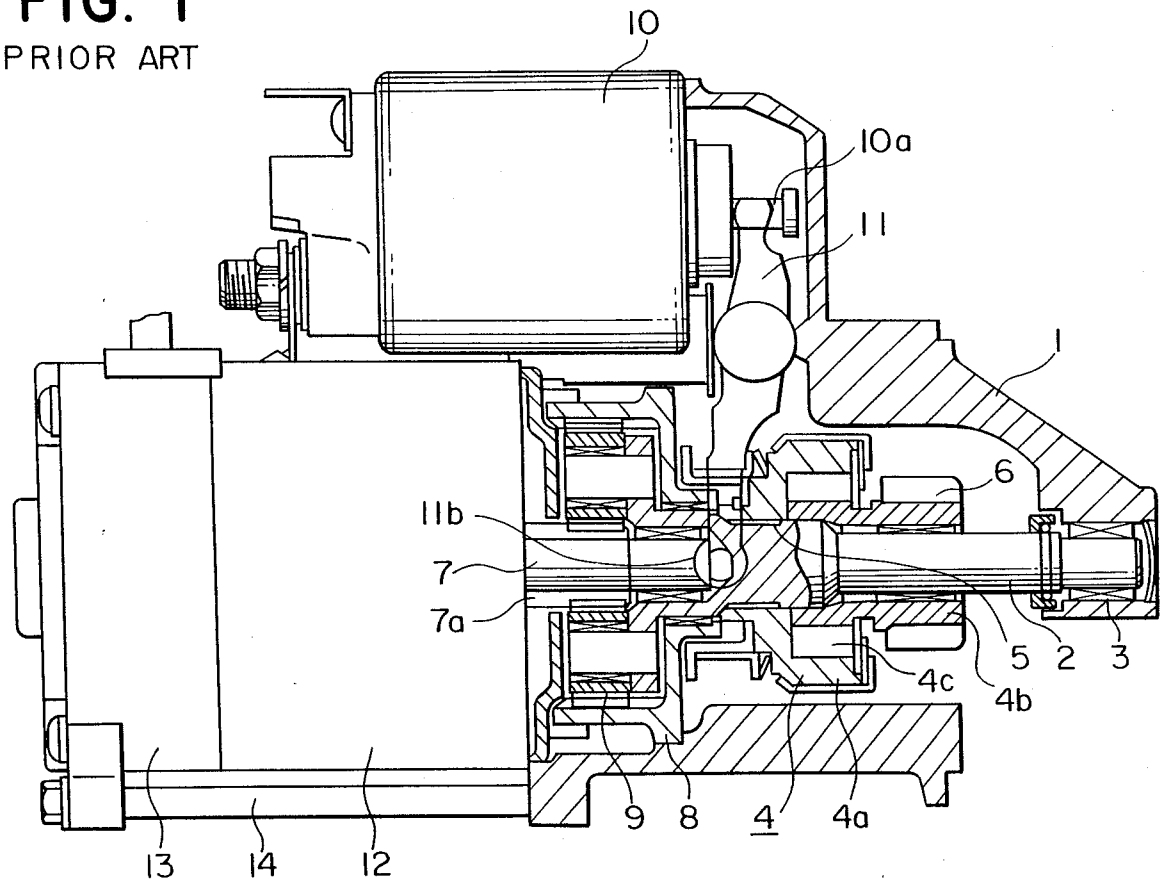
FIG. 1 PRIOR ART
FIG. 1 is a partial sectional side view of the conventional engine starter.
Figure 2:
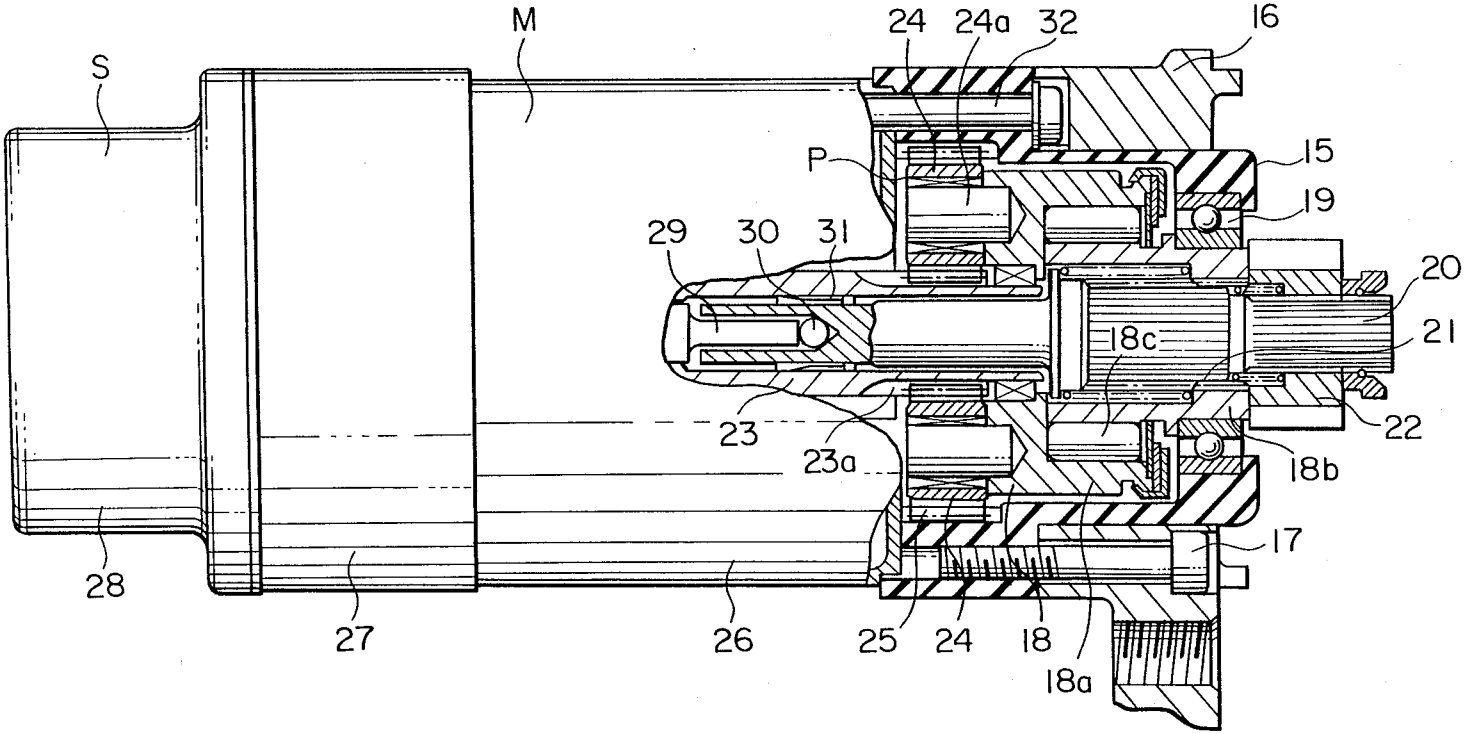
FIG. 2 is a partial sectional side view of the coaxial engine starter of one embodiment of the present invention.

FIG. 2 illustrates one embodiment of the coaxial engine starter of the present invention in a partial sectional view. The coaxial engine starter comprises a starter motor M having a rear bracket 27 and a solenoid switch S mounted to the rear bracket 27 of the electric motor M. A planetary speed reduction gear P is mounted on an output rotary shaft 23 of the electric motor M extending forwardly from the electric motor M.

The coaxial engine starter also comprises a starter housing or a front bracket 15 made of a suitable synthetic resin. The front bracket 15 is a hollow, substantially cylindrical member having a rear cylindrical wall having an inner gear 25 on its inner circumferential surface. A mounting flange 16 made of a metal is placed over and secured to the front bracket 15 by securing bolts 17 into the front bracket 18. The dimensions and the configuration of the front bracket 15 is adapted to the type of the engine to which the coaxial engine starter is attached. An over-running clutch 18 including a clutch outer member 18*a*, a clutch inner member 18*b* and a plurality of rollers 18*c* disposed between the clutch outer member 18*a* and the clutch inner member 18*b*. The clutch inner member 18*b* is rotatably supported at its front end by a radial bearing 19 fitted in the front end of the bore of the front bracket 15. The clutch inner member 18*b* has formed in its inner circumferential surface splines 21 which spline-meshes with the output rotary shaft 20. A pinion 22 also engages the front end of the output rotary shaft 20 through splines. The motor M has a hollow armature rotary shaft 23, which has formed on its front end a sun gear 23*a* of the planetary speed reduction gear P which also includes planetary gears 24 in mesh with the sun gear 23*a*. The planetary speed reduction gear P also includes an inner gear 25 integrally formed in the rearward extension of the front bracket 15 and planetary pins 24*a* secured to the clutch outer member 18*a* of the over-running clutch 18.

The coaxial engine starter further comprises a rod 29 disposed with the hollow armature rotary shaft 23 and connected through unillustrated plunger and a spring of the solenoid switch 28, a steel ball 30 disposed between the front end of the rod 29 and the output rotary shaft 20, a bearing 31 supporting the rear end of the output rotary shaft 20. Also provided are bolts 32 fixing the front bracket 15, the yoke 26, the rear bracket 27 and the solenoid switch 28. The bolts 32 extend through outside of the inner gear 25 of the front bracket 15 and inside of the yoke 26.

When unillustrated ignition switch is closed, the solenoid switch S is energized to attract its plunger to drive the output rotary shaft 20 through the rod 29, whereby the pinion 22 is brought into engagement with the unillustrated ring gear of the engine. At the same time, the electrical contacts within the solenoid switch 28 are closed to supply electrical power to the unillustrated armature to rotate the armature rotary shaft 23. This rotation is transmitted to the output rotary shaft 20 through the over-running clutch 18 after it is speed-reduced by the planetary speed reduction gear to rotate the pinion 22 to start the engine. Once the engine has been started, the rotational force from the engine is reversely transmitted through the ring gear to the pinion 22. Therefore, the pinion 22 together with the output rotary shaft 20 is driven fast, so that the clutch inner member 18*b* is disengaged from the clutch outer member 18*a* because of the function of the rollers 18*c* of the over-running clutch 18, whereby the rotation of the pinion 22 driven by the engine is not transmitted.

Figure 3:
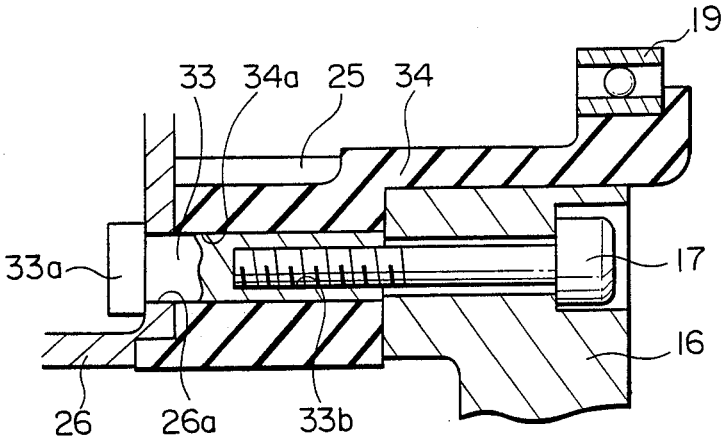
FIG. 3 is a fragmental sectional view showing how the front bracket is connected to the motor yoke.

FIG. 3 is a fragmental sectional view illustrating another embodiment of the coaxial engine starter of the present invention in which the flange 16 and the yoke 26 are electrically connected. It is seen from FIG. 3, that a front bracket 34 made of a synthetic resin has at least one through hole 34a at the position corresponding to one of the threaded holes into which the bolts 17 are thread engged as shown in FIG. 2. In other respects, the structure of the front bracket 34 is similar to the front bracket 15 shown in FIG. 2. An electrically conductive threaded connector rod 33 is inserted into a through hole 26*a* of the yoek 26 and the through hole 34*a* of the front bracket 34 with its head 33*a* in engagement with the inner surface of the yoke 26. The connector rod 33 has a female thread 33*b* into which the threaded end of the bolt 17 is thread engaged. Thus, since an electrical path from the starter yoke 26 to the metallic mounting flange 16 through the connector rod 33 and the bolt 17 is provided, an electrical connection for grounding the starter yoke 26 to the metallic bracket 16 is established through the insulating front bracket 34 without the need for separate grounding wiring for the yoke 26.

Figure 4:
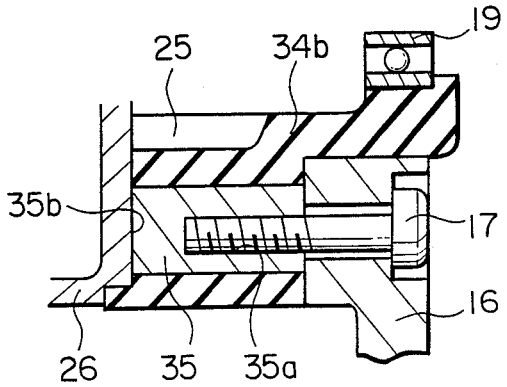
FIG. 4 is a view similar to FIG. 3 but showing another embodiment.

In FIG. 4, an electrically conductive connector bushing 35 having a female thread 35*b* and an end surface 35*b*, but no head corresponding to the head 33*a* shown in FIG. 3 is integrally molded within the front bracket 34*b* by insert-molding. When assembled as shown in FIG. 4, the end surface 35*b* is brought into an electrical contact with the outer surface of the yoke 26, thus establishing an electrical circuit from the yoke 26 to the flange 16 through the connector 35 and the bolt 17. The embedded connector 35 may also serve as a reinforcing member for the front bracket 34*b*.

As has been described, in the coaxial engine starter of the present invention, a housing to which a bearing for receiving radial loads from the output rotary shaft is secured and an inner gear of the planetary speed reduction gear are integrally formed by a synthetic resin material, and a mounting flange for attaching the starter to an engine is mounted to the housing. The mounting flange may be electrically conductive and may be mounted to the housing by an electrically conductive securing member, and electrically conducting means for electrically connecting the flange and a yoke of the electric motor through the securing member may be provided. In the coaxial engine starter as above described, the flange with which the starter is mounted to the engine is secured to the front bracket, so that the attachement of the engine starter to various types of the engine can be achieved by simply selecting a suitable mounting flange from different flanges previously prepared to fit to diffrent types of engines, reducing the manufacturing cost. Further, since the front bracket which has the inner gear of the planetary speed reduction gear assembly at its rear portion is made of an integrally molded synthetic resin, the front bracket with the inner gear can be made significantly light weight and by a single simple molding process, reducing the number of steps in manufacture. Therefore, the coaxial engine starter of the present invention can be manufactured at less expense and can be lighter than the conventional starter.

What is claimed is:

1. A coaxial engine starter in which a solenoid switch is disposed behind an electric motor, a planetary speed reduction gear is disposed in front of said electric motor, and an output rotary shaft is driven by said electric motor through said planetary speed reduction gear, wherein a housing to which a bearing for receiving radial loads from said output rotary shaft is secured and an inner gear of said planetary speed reduction gear are integrally formed by a resin, and wherein a flange for attaching the starter to an engine is mounted to said housing.

2. A coaxial engine starter as claimed in claim 1, wherein said flange for attaching the starter to an engine is metallic and mounted to said housing by an electrically conductive securing member, and further including electrically conducting means for electrically connecting said flange and a yoke of said electric motor through said securing member.

* * * * *